US012774860B2

(12) United States Patent
Emmerich et al.

(10) Patent No.: US 12,774,860 B2
(45) Date of Patent: Oct. 27, 2026

(54) PLATE HEAT EXCHANGER

(71) Applicant: Hanon Systems, Daejeon (KR)

(72) Inventors: Andreas Emmerich, Aachen (DE); Felix Girmscheid, Cologne (DE); Thoren Nölting, Cologne (DE)

(73) Assignee: HANON SYSTEMS, Daejeon (KR)

( * ) Notice: Subject to any disclaimer, the term of this patent is extended or adjusted under 35 U.S.C. 154(b) by 147 days.

(21) Appl. No.: 18/742,361

(22) Filed: Jun. 13, 2024

(65) Prior Publication Data

US 2024/0418457 A1 Dec. 19, 2024

(30) Foreign Application Priority Data

Jun. 13, 2023 (DE) ..... 10 2023 115 332.3
Apr. 8, 2024 (DE) ..... 10 2024 109 696.9

(51) Int. Cl.
*F28F 3/08* (2006.01)
*F28D 9/00* (2006.01)

(52) U.S. Cl.
CPC ..... *F28F 3/08* (2013.01); *F28D 9/0075* (2013.01); *F28D 9/0031* (2013.01); *F28D 9/0037* (2013.01); *F28D 9/0081* (2013.01)

(58) Field of Classification Search
CPC ..... F28F 3/08; F28D 9/0075; F28D 9/0031; F28D 9/0037; F28D 9/0081
See application file for complete search history.

(56) References Cited

U.S. PATENT DOCUMENTS 4,516,632 A * 5/1985 Swift ..... F28D 9/0075 366/DIG. 3
4,880,055 A * 11/1989 Niggemann ..... F28F 3/086 165/DIG. 360
4,993,487 A * 2/1991 Niggemann ..... F25B 39/00 165/DIG. 360
6,959,482 B2 11/2005 Matsumoto et al.
7,584,781 B2 9/2009 Lai et al.
8,161,997 B2 4/2012 Hoglund et al.
2003/0152488 A1 8/2003 Tonkovich et al.
2014/0060789 A1 3/2014 Rousseau
(Continued)

FOREIGN PATENT DOCUMENTS

FR 2752927 A1 3/1998
JP 19990306097 A 6/1992
JP 05164492 A 6/1993
(Continued)

*Primary Examiner* — Joel M Attey
(74) *Attorney, Agent, or Firm* — Shumaker, Loop & Kendrick, LLP; James D. Miller

(57) ABSTRACT

A plate heat exchanger for a refrigerant circuit, specifically for a refrigerant circuit in a vehicle, having channel plates with channel-forming cut-outs, of which at least two channel plates are in each case arranged into channel plate stacks, forming at least one channel, wherein first channel plate stacks for a first fluid and second channel plate stacks for a second fluid are stacked alternatingly between two cover plates with separating plates arranged therebetween to separate opposing channels, at least one of which cover plates has fluid connections for the first and/or the second fluid, wherein the channel-forming cut-out of in each case at least one channel plate of the first and second channel plate stacks has at least one stabilizing bridge oriented transversely to the channel.

14 Claims, 7 Drawing Sheets

(56) References Cited

U.S. PATENT DOCUMENTS

2019/0024986 A1* 1/2019 Bungo ..... F28D 1/0325

FOREIGN PATENT DOCUMENTS

| | | | |
|---|---|---|---|
| JP | 08178557 | A | 7/1996 |
| JP | 09138089 | A | 5/1997 |
| JP | 1997138089 | A | 5/1997 |
| JP | 3040138 | B2 | 3/2000 |
| JP | 2001215092 | A | 8/2001 |
| JP | 2007120941 | A | 5/2007 |
| JP | 2007242724 | A | 9/2007 |
| JP | 2018009727 | A | 1/2018 |
| KR | 1020180122289 | | 11/2018 |

* cited by examiner

PLATE HEAT EXCHANGER

CROSS-REFERENCE TO RELATED APPLICATIONS

The present application claims the benefit of and priority to German Patent Application No. 10 2024 109 696.9, filed Apr. 8, 2024 and German Patent Application No. 10 2023 115 332.3, filed Jun. 13, 2023, the entire contents of each of which are incorporated herein for all purposes by reference.

FIELD

The invention relates to a plate heat exchanger for transferring heat between two fluids, in particular between a coolant and a refrigerant. The plate heat exchanger is provided for use in a refrigerant circuit, specifically in a refrigerant circuit in a vehicle. Furthermore, the invention relates to a use of the plate heat exchanger as an integrated gas cooler in a refrigerant compressor.

BACKGROUND

Plate heat exchangers are used for heat transfer in various fields of technology. Plate heat exchangers play an important role in air-conditioning systems with a refrigerant circuit, in particular in vehicle air-conditioning systems, since they need a comparatively small amount of space. Thanks to their compact design, plate heat exchangers allow efficient heat transfer between two fluids flowing in a materially separate manner through the plate heat exchanger. The individual plates between which flow paths for the fluids are formed can consist of different materials. The connection and sealing of the individual plates take place for example by means of joining methods such as welding, brazing or adhesive bonding. The selection of the plate and connection materials depends on the fluids used, the temperature ranges, the working pressures, and the predominant materials in the air-conditioning system. When using the material of the plate heat exchanger, corrosion-critical connections should be avoided with regard to the predominant materials in the fluid circuit of the air-conditioning system and the brazing material used, in order to ensure a long service life.

Plate heat exchangers consisting of deep-drawn or stamped aluminum or steel sheets are known in which the individual plates can have material thicknesses of less than 0.6 mm. The small plate thicknesses of the channel plates are advantageous because the channel structures for the flow paths can be formed in a simple manner by stamping. However, a material thickness that is too small results in a low internal pressure resistance, and therefore the operation of plate heat exchangers with correspondingly small plate thicknesses is suitable only for certain refrigerants. The stability and external pressure resistance of such plate heat exchangers are also limited by external force influences, since the stamped or deep-drawn channels can be compressed when under more intense loading so that the volumetric flow through the channels is no longer ensured. The possibilities for fastening for example by screw-fastening to the compressor are thus limited or can be ensured only by additional stabilization elements.

It is expected that the refrigerant R744 will replace conventional refrigerants in future, and therefore an increased demand for correspondingly pressure-resistant plate heat exchangers for the automotive field is likely. Therefore, a plate heat exchanger that combines the advantages of low weight with the advantages of increased pressure resistance and can be integrated in a refrigerant circuit of a vehicle is desirable.

SUMMARY

The invention is therefore based on the object of proposing a compact and stable plate heat exchanger that has a low weight and withstands high operating pressures. The plate heat exchanger is to be designed in particular for use with the refrigerant R744 and for integration in a vehicle air-conditioning system. Furthermore, the plate heat exchanger is to be usable as an integrated gas cooler of a refrigerant compressor.

The object is achieved by a plate heat exchanger having the features shown and described herein.

A first aspect of the invention relates to a plate heat exchanger, which has channel plates with channel-forming cut-outs, of which at least two channel plates are in each case arranged into channel plate stacks, forming at least one channel. These channel plate stacks are divided into first channel plate stacks for a first fluid and second channel plate stacks for a second fluid. The first channel plate stacks for the first fluid and the second channel plate stacks for the second fluid are stacked alternatingly between two cover plates with separating plates arranged therebetween to separate opposing channels. At least one of the cover plates has fluid connections for the first and/or the second fluid. According to the invention, the channel-forming cut-out of in each case at least one channel plate of the first and second channel plate stacks has at least one stabilizing bridge oriented transversely to the channel.

In the plate heat exchanger according to the invention, the first channel plate stacks and the second channel plate stacks are stacked alternatingly, fluidically separated from one another, with separating plates between two cover plates. Each channel plate stack has at least one channel, which is covered by the separating plates or one of the two cover plates. Furthermore, each of the first and second channel plate stacks has first and second through-holes. The first through-holes of the second channel plate stacks correspond with the first through-holes of the first channel plate stacks and thus with the channels of the first channel plate stacks, as a result of which the first channel plate stacks are connected to one another. The first through-holes thus form a distributor channel or collection channel for the first fluid so that the first fluid can pass into the planes of the first channel plate stacks. The second through-holes of the first channel plate stacks correspond with the second through-holes of the second channel plate stacks and thus connect the channels of the second channel plate stacks so that the second channel plate stacks are connected fluidically to one another. The second through-holes thus form a distributor channel or collection channel for the second fluid so that the second fluid can pass into the planes of the second channel plate stacks. The first channel plate stacks thus form a first flow path for the first fluid, wherein the second channel plate stacks form a second flow path, which is separate from the first flow path, for the second fluid. In each case, at least one fluid connection as a fluid inlet and a further fluid connection as a fluid outlet are provided for each flow path. The fluid connections can have threads or be attached by brazing or welding.

According to the invention, the channel plate stacks are each formed from at least two channel plates that are stacked on top of one another and each have channel-forming cut-outs for forming at least one channel. In each case, at least one channel plate has, along a course of the channel-forming cut-out, at least one stabilizing bridge, which is oriented transversely to the channel and connects opposing flanks of the channel-forming cut-out to one another.

Within the meaning of the invention, the term "channel-forming cut-out" describes a usually elongate, track- or orbit-shaped through-hole in a channel plate. At least two channel plates stacked on top of one another form a corresponding cut-out that forms the at least one channel for the throughflow of the first or the second fluid when the resulting channel plate stack is arranged between two separating plates or between a separating plate and a cover plate. Accordingly, the channels formed from the channel-forming cut-outs of the first channel plate stacks have a fluid connection to the first through-holes of the second channel plate stacks, wherein the channels formed from the channel-forming cut-outs of the second channel plate stacks have a fluid connection to the second through-holes of the first channel plate stacks. To conduct the fluids, the separating plates likewise each have corresponding through-holes.

The channel plates, the channel-forming cut-outs, and the first and second through-holes can be formed using manufacturing methods such as punching, laser cutting or water jet cutting.

According to the invention, the channels for the throughflow of the first fluid and the second fluid separate therefrom are each formed in stacks of at least two channel plates, wherein in each case at least one channel plate of a channel plate stack has, along a course of the channel-forming cut-out of the channel plate in question, at least one stabilizing bridge oriented transversely to the channel. This stabilizing bridge forms an interruption of the channel-forming cut-out of the channel plate in question. Advantageously, this interruption acts as a supporting structural element that stabilizes the channel plate with the channel-forming cut-out formed therein and facilitates manufacturing, for example by punching. In this way, particularly delicate structures can be stabilized, which is advantageous in particular with small material thicknesses.

The individual first and second channel plate stacks are each separated by the separating plates or covered by the cover plates in a fluid-tight manner, wherein the separating plates or the cover plates cover opposing outer sides of the channel plate stacks. As a result, the at least one channel of a channel plate stack is also covered in a fluid-tight manner on both sides by separating plates or by a separating plate and a cover element.

The channel plates can be formed from steel or aluminum or an aluminum alloy, wherein aluminum is the preferred material owing to the lower weight. Advantageously, the use of thin channel plates consisting of aluminum helps to reduce weight without having to do without a necessary pressure resistance, with correspondingly dimensioned separating plates and cover plates. The separating plates and the cover plates can likewise be formed from aluminum and have a greater material thickness than a channel plate of the first and second channel plate stacks. An improved pressure resistance can thus be ensured within the plate heat exchanger, since the material thickness of the separating plates and the cover plates can be adapted to a necessary pressure resistance. The separating plates and the cover plates contain the first through-holes necessary for the fluid connection of the first channel plate stacks and the second through-holes necessary for the fluid connection of the second channel plate stacks. Each first channel plate stack thus has a second through-hole for directly conducting the second fluid, wherein each second channel plate stack has a first through-hole for directly conducting the first fluid. The totality of the first through-holes forms a distributor channel or a collection channel for the first fluid, wherein the totality of the second through-holes forms a distributor channel or a collection channel for the second fluid.

It has been found that production of the channel plates by punching is simplified in manufacturing terms when the thickness of the sheet out of which the channel plates are punched is in the range of 1 mm to 0.6 mm. Accordingly, the individual channel plates of the first and second channel plate stacks can have a thickness in the range of 1 mm to 0.6 mm.

The connection of the individual channel plates to one another and to the separating plates and/or the cover plates can be produced by a joining method such as brazing, welding or adhesive bonding. In the case of brazing, the use of a suitable brazing metal must be ensured, to avoid connections susceptible to corrosion.

The individual channel plates, the separating plates, the cover plates, and the connection between the plates can be dimensioned such that the plate heat exchanger withstands an operating pressure of 200 bar.

The channel height of the at least one channel of the first and second channel plate stacks is defined by the number of channel plates and the material thickness of the channel plates. The channel height is limited by two separating plates or a separating plate and a cover plate. The channel height is influenced only at positions at which a channel-forming cut-out of one of the channel plates of the channel plate stack in question has a stabilizing bridge. The stabilizing bridges present along the at least one channel locally reduce the flow cross section of the channel formed, as a result of which the flow speed and the turbulence are advantageously increased and thus the heat transfer is improved. If there are multiple parallel individual channels, the distribution of the fluid flowing through can advantageously be influenced by the number of stabilizing bridges and the length of the individual stabilizing bridges, in order to ensure improved heat transfer.

According to a preferred embodiment of the plate heat exchanger, in which the first and second channel plate stacks are each formed from multiple stacked channel plates, it can be provided for each second channel plate to have at least one stabilizing bridge oriented transversely to the channel. In this case, the channel plates with stabilizing bridge and the channel plates that do not have any stabilizing bridges in their channel-forming cut-out can be arranged alternatingly. Channel plates A with stabilizing bridge and channel plates B that do not have any stabilizing bridges can be arranged in the stacking order A-B-A-B.

According to a further embodiment of the plate heat exchanger, each channel plate of the first channel plate stacks and of the second channel plate stacks can have a stabilizing bridge oriented transversely to the at least one channel, wherein the stabilizing bridges of channel plates stacked on top of one another are offset along the course of the at least one channel. In other words, the stabilizing bridges are offset such that a fluid flow through the channel formed is not blocked. Channel plates A with stabilizing bridge and channel plates C in which the stabilizing bridge is formed at a different position in the channel-forming cut-out can be arranged in the stacking order A-C-A-C. Also possible are combined stacking orders with channel plates B, which do not have any stabilizing bridges. Stacking orders such as A-B-C-A-B-C and further combinations can result from this.

According to the invention, the channel-forming cut-out of a channel plate is stabilized by the at least one stabilizing bridge, wherein a channel-forming cut-out that results in the formation of a long channel within the channel plate stack has more than just one stabilizing bridge. This means: The longer the channel, the greater the number of stabilizing bridges of a channel-forming cut-out can be. A channel-forming cut-out of a channel plate can thus have a plurality of the stabilizing bridges.

Dimensioning of the at least one stabilizing bridge of the channel-forming cut-out of a channel plate can depend on the width of the channel formed by the channel-forming cut-out. The at least one stabilizing bridge can thus have a width that corresponds at least to the width of the at least one channel formed. However, as already mentioned above, the stabilizing bridge can also be much wider than the width of the channel in order to influence the flow through the channel in question.

The channel plates can each have multiple channel-forming cut-outs, which each form a channel structure having multiple individual channels, wherein each individual channel has at least one stabilizing bridge oriented transversely to the individual channel. The multiple individual channels can be arranged regularly or irregularly. Preferably, the individual channels of the channel structure are arranged adjacently in parallel at a distance from one another. The individual channels of the channel structure can originate from a common channel stack inlet and lead into a common channel stack outlet. The channel stack inlet and the channel stack outlet of a channel plate stack correspond with through-holes formed in the separating plates, i.e., with the respective first and second through-holes.

According to a preferred embodiment of the channel plates, it can be provided for a plurality of the channel-forming cut-outs to be formed such that they are arranged in concentric rings, so that the stacked channel plates form multiple spaced ring-shaped individual channels. In this case, the stabilizing bridges of adjacent ring-shaped channel-forming cut-outs can be radially offset. It has been found that production is simplified by the radially offset arrangement of the stabilizing bridges. The radially offset arrangement of the stabilizing bridges is also advantageous for the stability of the delicate structure of the channel-forming cut-outs. In this embodiment too, the stabilizing bridges of the channel-forming cut-outs are offset along a formed channel of stacked channel plates such that a fluid through-flow is ensured. The channel plates thus formed can be arranged as first channel plate stacks and/or as second channel plate stacks. The ring-shaped individual channels can have a common inlet and a common outlet, wherein the common inlet and the common outlet are each formed with first through-holes and second through-holes, respectively. It can also be provided in this embodiment of the channel plates for a width of the ring-shaped channel-forming cut-outs to decrease from the outside inwards. This means that the multiple concentric rings formed by the ring-shaped cut-outs have different widths, wherein the width of the ring-shaped cut-outs decreases from the outer ring to the inner ring. The ring-shaped individual channels then formed when the channel plates are stacked thus have a flow cross section that decreases from the outer ring-shaped individual channel to the inner ring-shaped individual channel. The individual channels formed then each have different widths and cross sections. It has been found that an improved distribution of the fluid flowing through is achieved by this measure, which results in an even better heat transfer performance.

The surface contact of the individual channel plates, the separating plates and the cover plates allows a particularly compact and stable design of the plate heat exchanger. The improved stability allows screw-fastening to components of a refrigerant circuit, in particular to a refrigerant compressor of a refrigerant circuit, without additional stabilization elements being required. The channel plates, separating plates and cover plates can thus each have multiple corresponding bushings for screws or bolts. These screw bushings or bolt bushings are provided to screw the plate heat exchanger directly to the refrigerant compressor, for example. The bushings for the screws or bolts are preferably arranged at the edges and distributed as evenly as possible in order to achieve uniform force distribution during screw-fastening. Thanks to the compact design of the plate heat exchanger, the channels formed remain leakproof and dimensionally stable even under external force effects as can occur during screw-fastening.

The channel-forming cut-outs can have a shape that forms at least one channel having an at least partially serpentine course. In this respect, a channel structure in which multiple individual channels running next to one another have an at least partially serpentine course can also be provided.

According to one embodiment of the plate heat exchanger according to the invention, the cover plates, the first and second channel plate stacks, and the separating plates arranged therebetween can have a substantially circular basic shape, wherein the fluid connections for the first fluid and/or for the second fluid are formed at the radial circumference of the plate heat exchanger. In this embodiment, the plate heat exchanger has a cylindrical shape, wherein the fluid connections for a first fluid are formed on a protrusion projecting from the circumference of the cylindrical shape. The fluid connections for a second fluid can be formed in the cover plates. A first fluid connection can be designed as a fluid inlet for the first fluid in a first cover element, wherein a second fluid connection is designed as a fluid outlet for the first fluid in a second cover element. This embodiment of the plate heat exchanger is suitable in particular for integration in a refrigerant compressor in a refrigerant circuit.

The plate heat exchanger according to the invention allows an arrangement for parallel or serial flow of the fluids through multiple channel plate stacks. The first channel plate stacks and, fluidically separately therefrom, the second channel plate stacks can thus be fluidically connected in series or in parallel.

Thanks to the invention, a high-pressure-resistant and compact plate heat exchanger with low weight is provided. Delicate channel structures in robust channel plates that are suitable for punching and are arranged to form channel plate stacks allow high heat transfer performance while keeping production costs low.

A further aspect of the invention is the use of the above-described plate heat exchanger in a refrigerant circuit having refrigerant R744.

A still further aspect of the invention is the use of the plate heat exchanger as an integrated gas cooler in a refrigerant compressor, specifically in a refrigerant compressor of a vehicle. The plate heat exchanger can assume the function of an inner heat exchanger in the case of multi-stage compression. According to this use of the plate heat exchanger, the plate heat exchanger can be arranged downstream of a compression stage and screw-fastened to the refrigerant compressor so that the plate heat exchanger is situated on the refrigerant outlet side of the refrigerant compressor.

The plate heat exchanger according to the invention has even more advantages. For instance, the pulsations on the refrigerant outlet side of a refrigerant compressor are damped by the internal additional volume of the plate heat exchanger downstream of the compression stage in the refrigerant compressor, and a reduced noise emission of the refrigerant compressor in the vehicle is achieved as a result. In addition to the pulsation damping by means of the internal volume of the plate heat exchanger, the inner structure of the channel-forming cut-outs with the stabilizing bridges is formed such that the pulsations in the parallel individual channels interfere destructively owing to the different run lengths and thus result in a reduction in pulsations generated by the refrigerant compressor. This also results in a reduction in the noise emission of the refrigerant compressor. The plate heat exchanger according to the invention can therefore be used additionally as a muffler. Therefore, when the plate heat exchanger is used in a refrigerant circuit, for example as an integrated gas cooler in a refrigerant compressor, specifically in a refrigerant compressor of a vehicle, an additional muffler is not necessary, since damping and reduction of the noise emission can be ensured by the plate heat exchanger. The plate heat exchanger can thus be used as a muffler in air-conditioning systems having refrigerant compressors.

BRIEF DESCRIPTION OF THE DRAWINGS

Further details, features and advantages of embodiments of the invention can be found in the description of exemplary embodiments below with reference to the associated drawings. In the drawings.

DETAILED DESCRIPTION

Recurring features are labelled with the same reference signs in the figures.

Figure 1A:
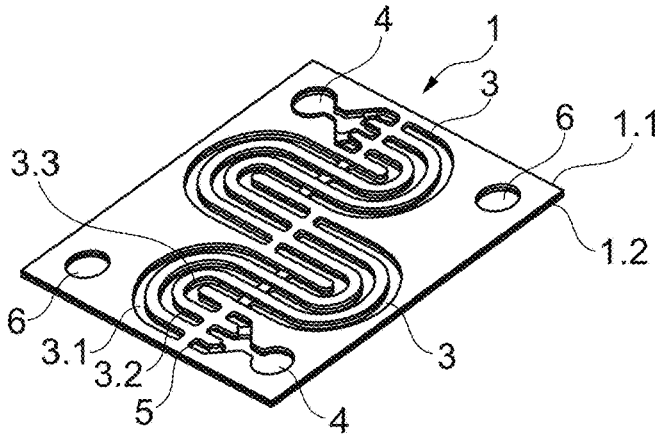
FIGS. 1A-ID: show schematic diagrams of an exemplary embodiment of channel plates of a plate heat exchanger according to the invention.

FIGS. 1A-1D show schematic diagrams of an exemplary embodiment of channel plates of a plate heat exchanger according to the invention. FIG. 1A shows a perspective view of two channel plates 1.1 and 1.2, which are formed from aluminum and are stacked on top of one another to form a first channel plate stack 1. Both channel plates 1.1 and 1.2 have corresponding channel-forming cut-outs 3, which form three individual channels 3.1, 3.2 and 3.3 running adjacently and at distance from one another in a serpentine manner within the first channel plate stack 1. In the plane, the individual channels 3.1, 3.2 and 3.3 correspond with first through-holes 4. The channel-forming cut-outs 3 of two channel plates 1.1 and 1.2 each have, along the course of the individual channels 3.1, 3.2 and 3.3, stabilizing bridges 5 oriented transversely to the individual channels 3.1, 3.2 and 3.3. Three stabilizing bridges 5 are formed along the course of a channel-forming cut-out 3 of the channel plate 1.1, wherein two stabilizing bridges 5 are formed along the course of a channel-forming cut-out 3 of the channel plate 1.2. The stabilizing bridges 5 of corresponding channel-forming cut-outs 3 of the channel plate 1.1 and the channel plate 1.2 are offset along the course of the individual channels 3.1, 3.2 and 3.3 formed. Because the stabilizing bridges 5 of the channel plates 1.1 and 1.2 stacked on top of one another are offset, a fluid flow through the individual channels 3.1, 3.2 and 3.3 formed is ensured. The stabilizing bridges 5 each form an interruption of the course of the channel-forming cut-outs 3 of the channel plates 1.1 and 1.2.

The channel plates 1.1 and 1.2 also have corresponding second through-holes 6, which serve for fluid connection of second channel plate stacks 2, which are not shown in the diagram.

Figure 1B:
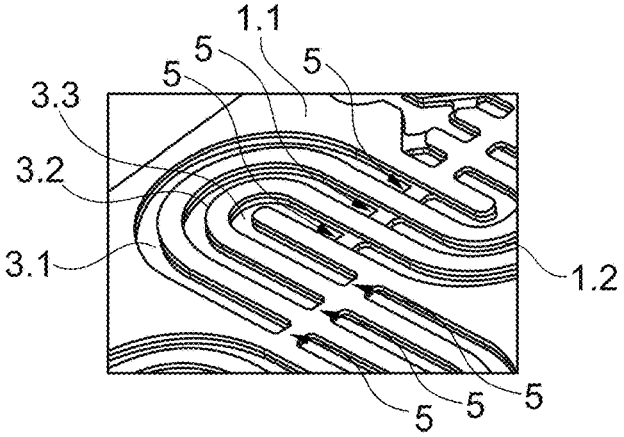

FIG. 1B shows a detail of FIG. 1A. It can be seen in the detail that the stabilizing bridges 5, stabilizing the channel-forming cut-outs 3, of the channel plates 1.1 and 1.2 stacked on top of one another are arranged at different positions in the course of the individual channels 3.1, 3.2 and 3.3 formed. The stabilizing bridges 5 are thus offset in the course of the individual channels 3.1, 3.2 and 3.3 formed. At the positions at which the individual channels 3.1, 3.2 and 3.3 formed have a stabilizing bridge 5, a channel height of the individual channel 3.1, 3.2 or 3.3 in question is equal to the thickness of the channel plate 1.1 or 1.2 formed from aluminum. In the example shown, the channel plates have a thickness of 0.8 mm, and therefore the channel height in regions in which there is no stabilizing bridge 5 is 1.6 mm. At the positions at which the channel-forming cut-outs 3 have a stabilizing bridge 5, the channel height is accordingly 0.8 mm. The width of the individual channels 3.1, 3.2 and 3.3 is 3 mm, wherein the stabilizing bridges 5 oriented transversely to the individual channels 3.1, 3.2 and 3.3 likewise have a width of 3 mm. According to one embodiment, it can be provided for the individual channels 3.1, 3.2 and 3.3 to have a different width. In this case, the stabilizing bridges 5 can also be adapted to the width of the individual channels 3.1, 3.2 and 3.3 and thus have a different width from adjacent individual channels.

Figure 1C:
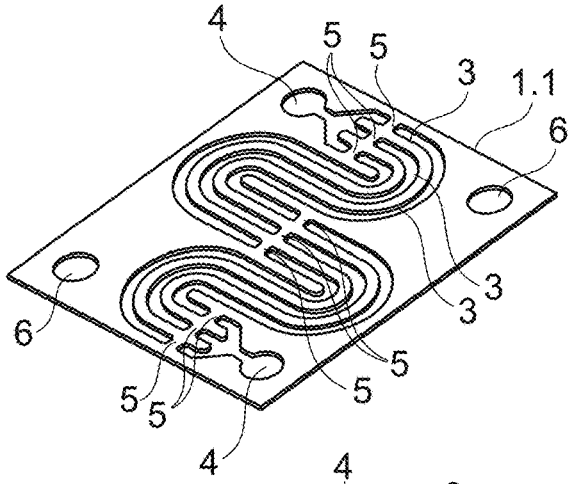

FIG. 1C shows the channel plate 1.1, formed from aluminum, of the first channel plate stack (FIG. 1A) separately with the channel-forming cut-outs 3 formed therein, the first through-holes 4, and the second through-holes 6. The three channel-forming cut-outs 3 have an elongate geometry running adjacently and at an equal distance from one another in a serpentine manner, which is interrupted by the stabilizing bridges 5 at three positions. Thanks to the stabilizing bridges 5, the delicate structures of the channel-forming cut-outs 3 can simply be punched. Furthermore, the stabilizing bridges 5 give the entire channel-forming structure improved stability, as a result of which the handling of the channel plate 1.1 is improved.

Figure 1D:
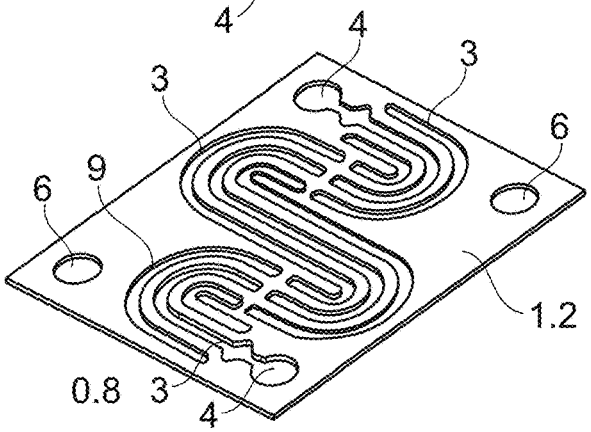

FIG. 1D shows the channel plate 1.2, formed from aluminum, of the first channel plate stack (FIG. 1A) separately with the channel-forming cut-outs 3 formed therein, the first through-holes 4, and the second through-holes 6, which correspond with the first through-holes 4 and second through-holes 6 formed in the channel plate 1.1. The first through-holes 4 act as a channel stack inlet or channel stack outlet for the first fluid.

FIGS. 2A to 2D show schematic diagrams of an exemplary embodiment of a plate heat exchanger 7 according to the invention. FIGS. 2A to 2D each show a perspective view from above.

Figure 2A:
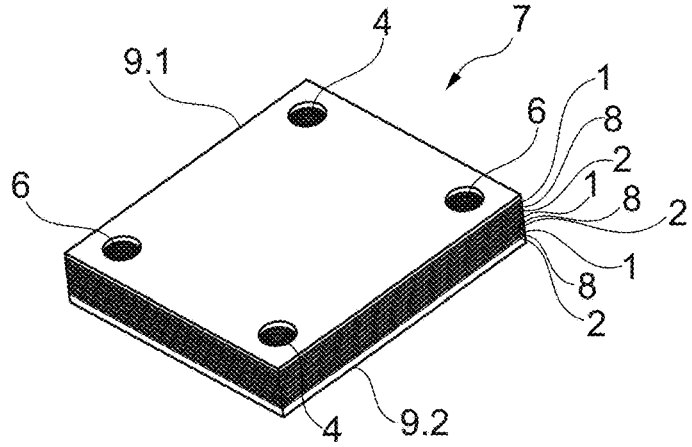
FIGS. 2A-2D: show schematic diagrams of an exemplary embodiment of a plate heat exchanger according to the invention.

FIG. 2A shows the plate heat exchanger 7 in the assembled state, wherein first channel plate stacks 1 for a first fluid and second channel plate stacks 2 for a second fluid are stacked alternatingly between two cover plates 9.1 and 9.2 with separating plates 8 arranged therebetween to separate opposing channels. The first channel plate stacks 1, the second channel plate stacks 2, the separating plates 8, and the cover plates 9.1 and 9.2 are formed from aluminum and brazed fluid-tightly to one another. The upper cover plate 9.1 has first through-holes 4, which correspond with the first through-holes 4 formed in the first and second channel plate stacks 1 and 2. The cover plate 9.1 also has two second through-holes 6, which correspond with the second through-holes 6 formed in the first and second channel plate stacks 1 and 2. The first through-holes 4 act as fluid connections for the first fluid, wherein the second through-holes 6 form fluid connections for the second fluid. Owing to the stacked arrangement, the first through-holes 4 form a distributor channel for the first fluid in the plate planes of the first channel plate stacks 1, so that the first fluid can pass into the respective individual channels 3.1, 3.2 and 3.3 before leading into a collection channel formed by the first through-holes 4 on the diagonally opposite side of the plate heat exchanger 7. In the stacked arrangement, the first channel plate stacks 1 are thus connected to one another by the corresponding first through-holes 4 so that a first flow path for the first fluid is formed. The corresponding second through-holes 6 connect the second channel plate stacks 2 to one another so that a second flow path for the second fluid, separate from the first flow path for the first fluid, is formed. The second through-holes 6 form a distributor channel for the second fluid in the plate planes of second first channel plate stack 2 (see FIG. 2D), so that the second fluid can pass into the respective individual channels 3.1, 3.2 and 3.3 of the second channel plate stack 2 before leading into a collection channel formed by the second through-holes 6 on the diagonally opposite side of the plate heat exchanger 7. In the example, the plate heat exchanger 7 has a substantially rectangular basic shape.

Figure 2B:
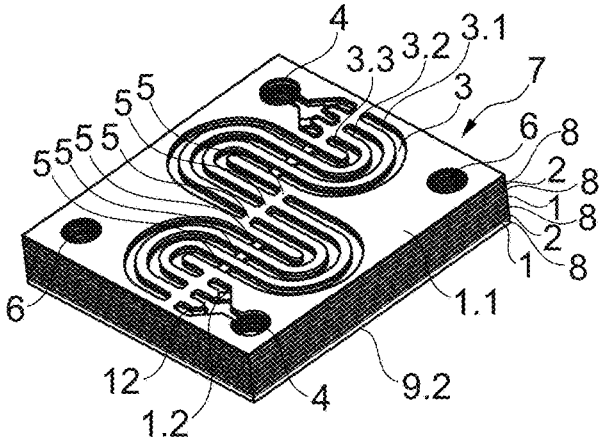

FIG. 2B shows the plate heat exchanger 7 shown in FIG. 2A, wherein the upper cover plate 9.1 is omitted to allow a view of one of the first channel plate stacks 1. The first channel plate stack 1 that can be seen corresponds to the embodiment of the channel plate stack 1 that is shown in FIGS. 1A and 1*s* formed from the two stacked channel plates 1.1 and 1.2 (see FIGS. 1A-1D). While the omitted upper cover plate 9.1 forms the upper boundary of the individual channels 3.1, 3.2 and 3.3 or covers the individual channels 3.1, 3.2 and 3.3, the lower boundary or cover of the individual channels 3.1, 3.2 and 3.3 is ensured by the separating plate 8. The separating plate 8 separates successive first and second channel plate stacks 1 and 2. The channel height reduced by the stabilizing bridges 5 within the individual channels 3.1, 3.2 and 3.3 advantageously helps to locally accelerate the fluid flowing through, as a result of which turbulence is generated, which facilitates heat transfer. The fluid distribution in the parallel individual channels can be influenced by the number and length of the stabilizing bridges 5.

Figure 2C:
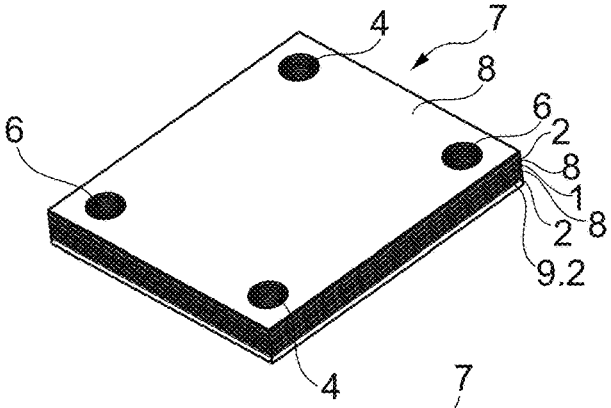

FIG. 2C shows the plate heat exchanger 7 shown in FIG. 2B. In this diagram, it is possible to see a separating plate 8 separating the first and second channel plate stacks 1 and 2. In the diagram shown, the separating plate 8 covers a second channel plate stack 2. The separating plate 8 formed from aluminum has the corresponding first through-holes 4 and second through-holes 6.

Figure 2D:
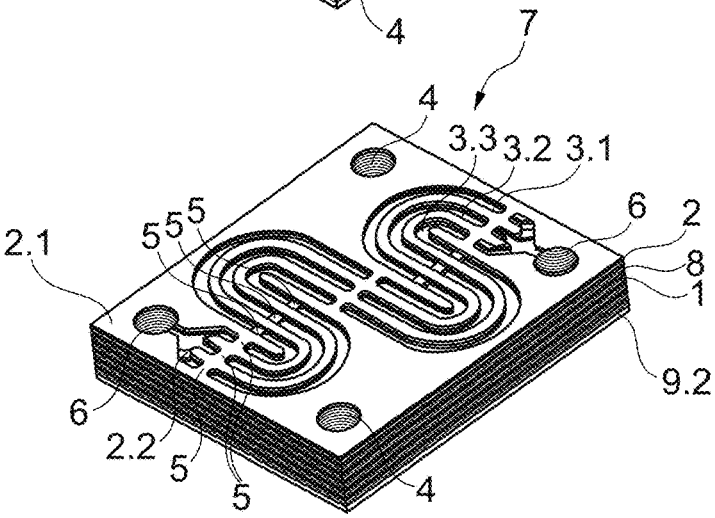

FIG. 2D likewise shows the plate heat exchanger 7 shown in FIGS. 2A to 2C, wherein the second channel plate stack 2 can be seen. The second channel plate stack 2 likewise consists of channel plates 2.1 and 2.2 stacked on top of one another. The channel plates 2.1 and 2.2 of the second channel plate stack 2 are formed mirror-symmetrically to the channel plates 1.1 and 1.2 of the first channel plate stack 1. The channel-forming cut-outs 3 of both channel plates 2.1 and 2.2 have stabilizing bridges 5, wherein the individual channels 3.1, 3.2 and 3.3 formed correspond with the second through-holes 6. The individual channels 3.1, 3.2 and 3.3 formed are used to conduct the second fluid. The second channel plate stack 2 also has first through-holes 4, which allow the first fluid to be conducted through. The channel plate stack 2 lies with the channel plate 1.2 on a separating plate 8, which forms the lower boundary for the individual channels 3.1, 3.2 and 3.3.

Figure 3A:
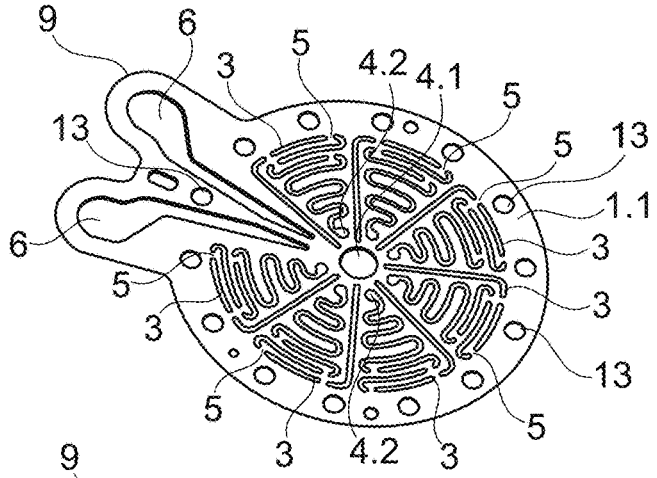
FIGS. 3A-3D: show schematic diagrams of channel plates of an embodiment of the plate heat exchanger.
Figure 3B:
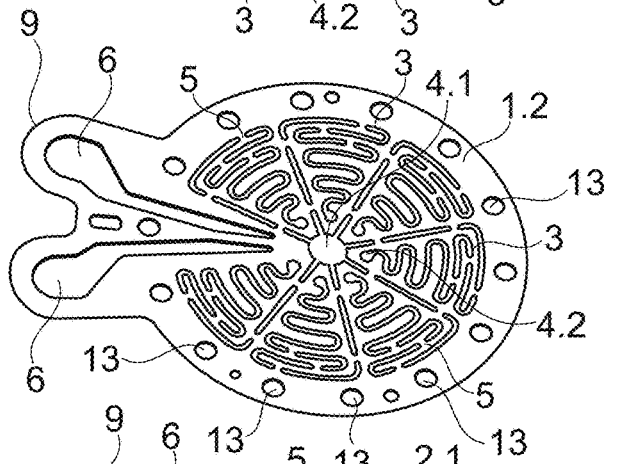

FIGS. 3A to 3D show schematic diagrams of channel plates 1.1, 1.2 and 2.1 and 2.2 of a further embodiment of the plate heat exchanger 7 according to the invention, which is provided as an integrated gas cooler for screw-fastening to a compressor. The channel plates 1.1. 1.2 and 2.1 and 2.2 shown in FIGS. 3A to 3D are formed from aluminum and each have a substantially circular shape, on the outer circumference of which a protrusion 9 is formed, wherein inwardly directed second through-holes 6 are formed in the protrusion 9 in order to conduct the second fluid. FIG. 3A shows a channel plate 1.1 of a first channel plate stack 1, wherein FIG. 3B shows a further channel plate 1.2 of a first channel plate stack 1. Both channel plates 1.1 and 1.2 have corresponding channel-forming cut-outs 3. The channel-forming cut-outs 3 of both channel plates 1.1 and 1.2 each have transversely oriented stabilizing bridges 5 along their course. The positions of the stabilizing bridges 5 in the otherwise corresponding channel-forming cut-outs 3 of the channel plates 1.1 and 1.2 are different, so that the stabilizing bridges 5 of the stacked channel plates 1.1 and 1.2 are offset in the resulting individual channels 3.1 to 3.7 (see FIGS. 4A and 4C). In the centre of the channel plates 1.1 and 1.2 there are a central first through-hole 4.1 and multiple smaller radially spaced further first through-holes 4.2. The first through-holes 4.1 and 4.2 are used to conduct the first fluid. The channel-forming cut-outs 3 have a portion with a serpentine course.

Figure 3C:
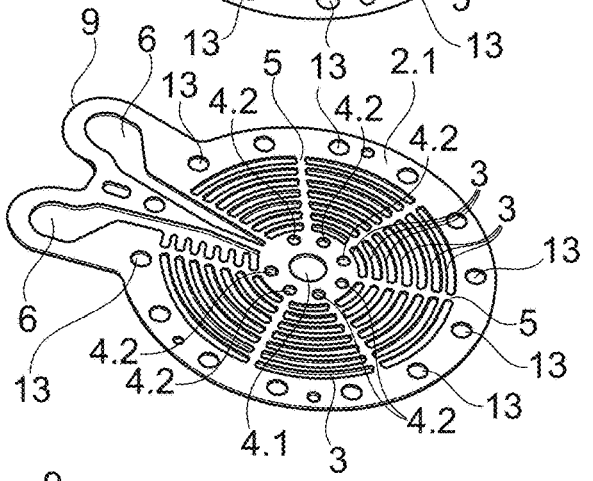
Figure 3D:
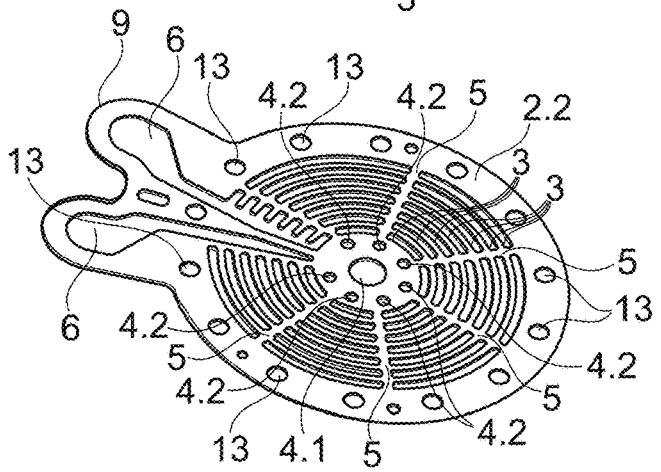

FIG. 3C shows a channel plate 2.1 of a second channel plate stack 2 (see FIG. 5), wherein FIG. 3D shows a further channel plate 2.2 of a second channel plate stack 2. Both channel plates 2.1 and 2.2 have corresponding channel-forming cut-outs 3. The channel-forming cut-outs 3 are geometrically a different shape from the channel-forming cut-outs 3 of the channel plates 1.1 and 1.2. The channel-forming cut-outs 3 of the channel plates 2.1 and 2.2 are thus spaced from one another in rings, wherein each ring-shaped channel-forming cut-out 3 has multiple transversely oriented stabilizing bridges 5 along its course. The stabilizing bridges 5 each lie on a radial. Owing to the stabilizing bridges 5, the ring-shaped channel-forming cut-outs 3 of the channel plates 2.1 and 2.2 are interrupted, so that the channel-forming cut-outs 3 are each formed from multiple circular ring portions arranged concentrically around the first through-hole 4.1. The positions of the stabilizing bridges 5 in the channel-forming cut-outs 3 of the channel plates 2.1 and 2.2 are different, so that the stabilizing bridges 5 of the stacked channel plates 2.1 and 2.2 are offset in the resulting individual channels 3.1 to 3.7 (see FIGS. 4A and 4C) for the second fluid, which allows the second fluid to flow through. In the centre of the channel plates 2.1 and 2.2 there are a central first through-hole 4.1 and multiple smaller radially spaced further first through-holes 4.2. These first through-holes 4.1 and 4.2 each correspond with the first through-holes 4.1 and 4.2 of the channel plates 2.1 and 2.2 and are used to conduct the first fluid.

Figure 5B:
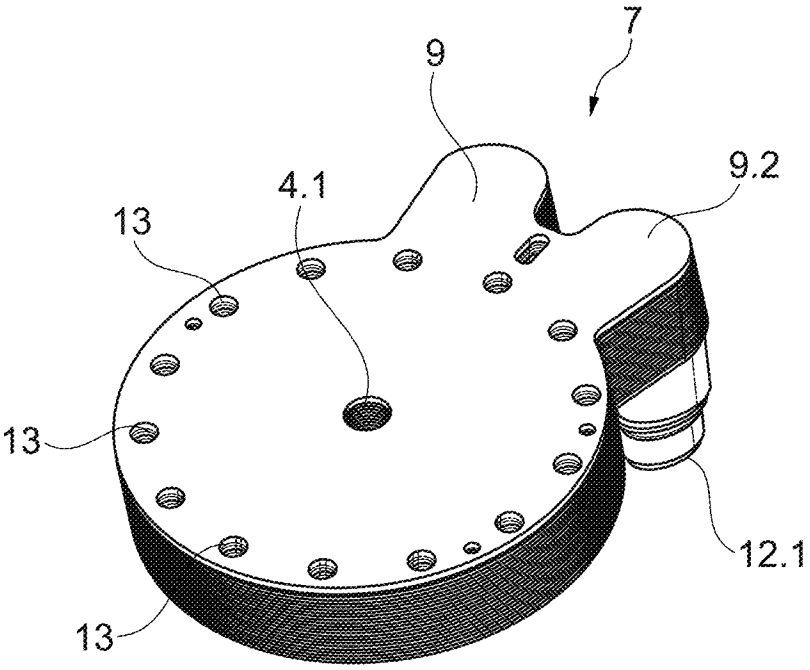
FIGS. 5A and 5B: show schematic diagrams of an embodiment of the plate heat exchanger in an assembled form.
Figure 5A:
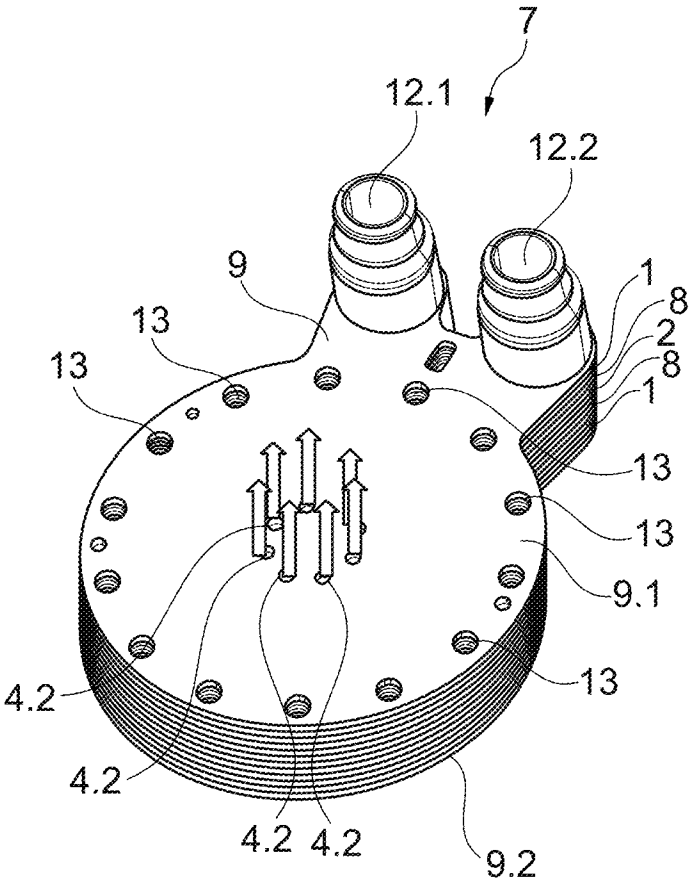
Figure 6:
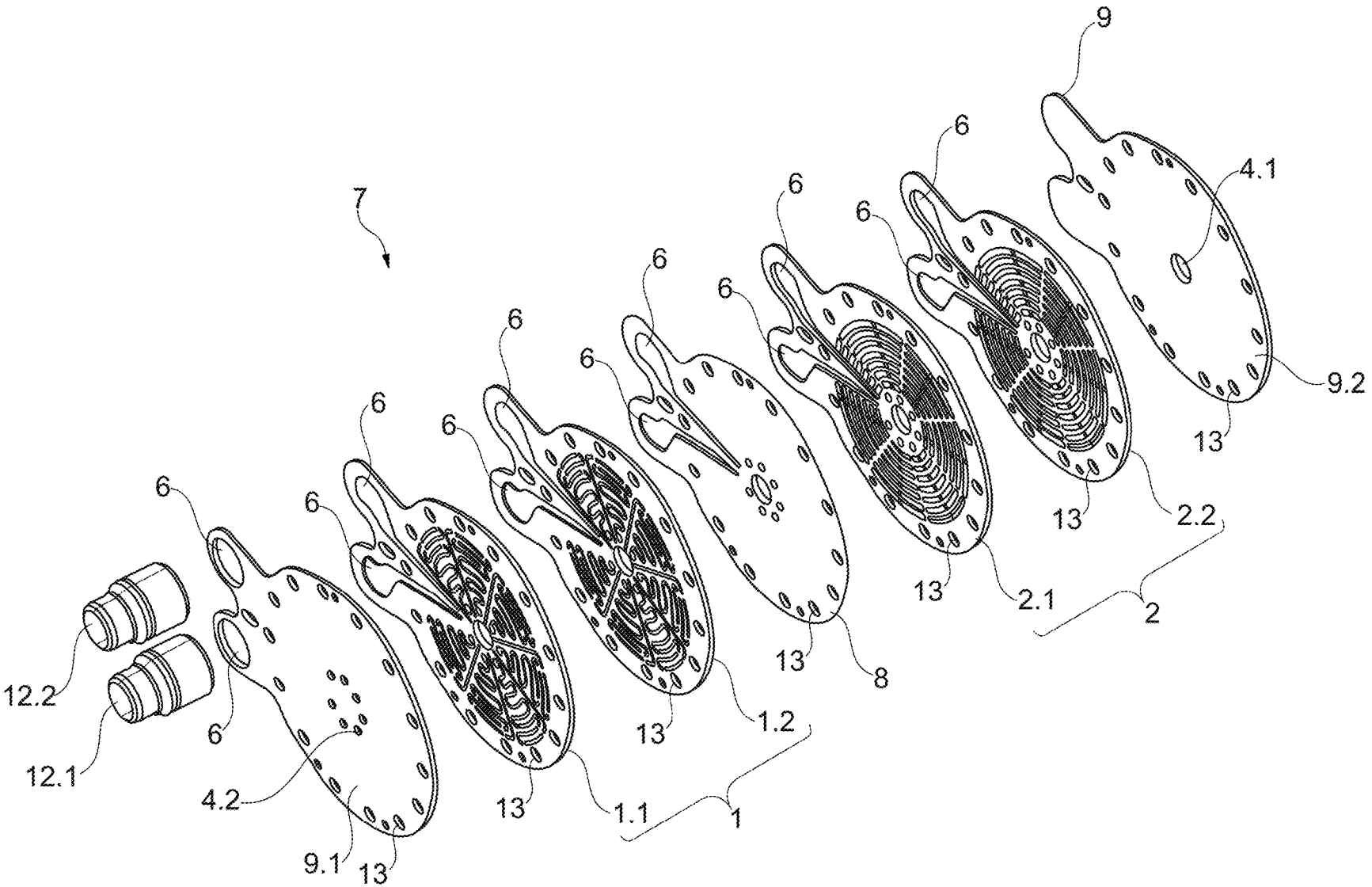
FIG. 6: shows an exploded diagram of an embodiment of the plate heat exchanger according to the invention.

The individual channel plates 1.1, 1.2 and 2.1 and 2.2 of FIGS. 3A to 3D each have fourteen bushings 13 for screws or bolts, which correspond with one another in the stacked state such that the assembled plate heat exchanger 7 (see FIGS. 5A and 5B) can be screw-fastened to a refrigerant compressor by means of screws or bolts fed through the bushings 13. The bushings 13 are each arranged at an equal distance from the first through-hole 4.2 formed in the centre. Accordingly, the separating plates 8 and the cover plates 9.1 and 9.2 likewise have corresponding bushings 13, as can be seen in FIGS. 5A, 5B and 6.

Figure 3E:
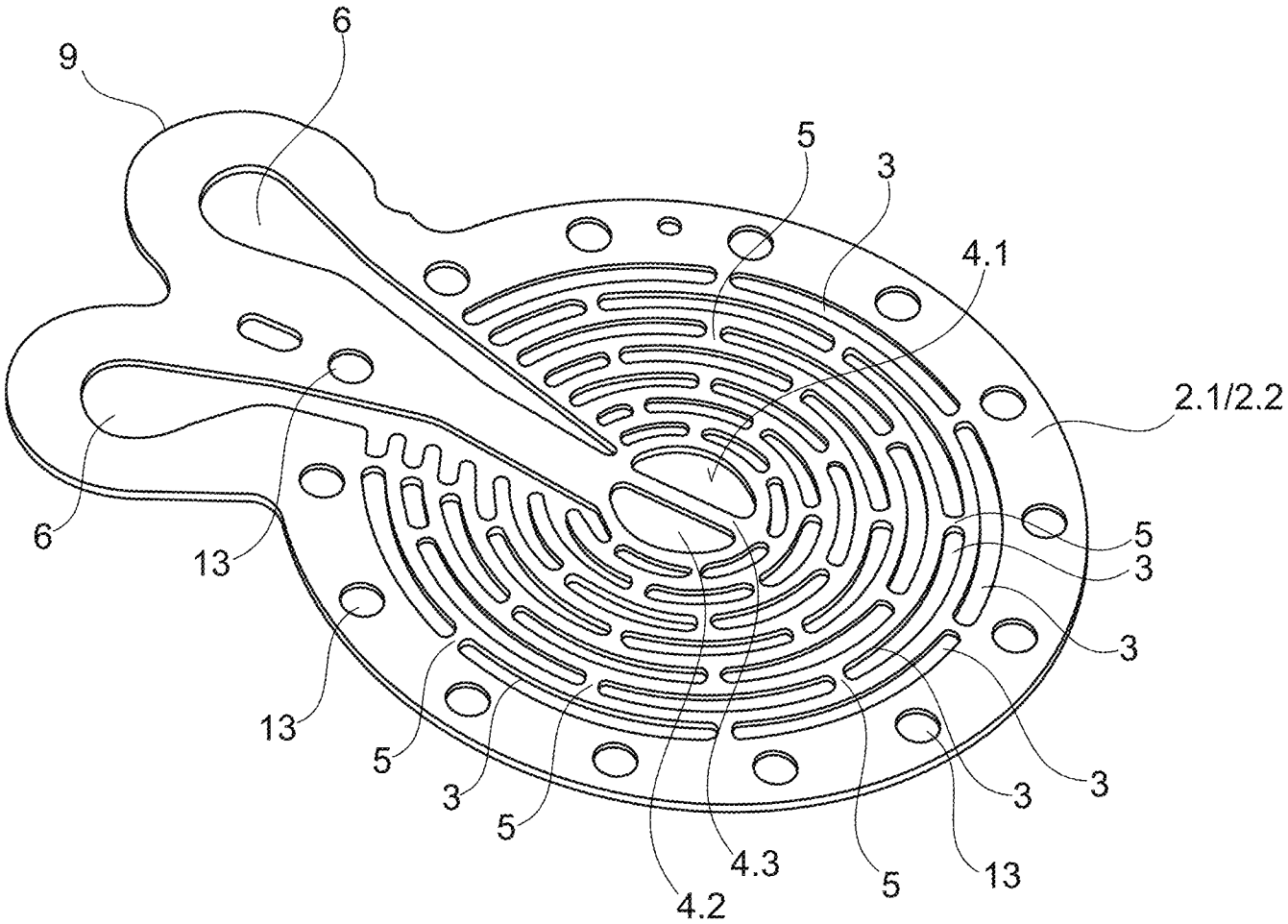
FIG. 3E: shows a schematic diagram of an alternative embodiment of a channel plate of the plate heat exchanger.

FIG. 3E shows a schematic diagram of a preferred alternative embodiment of a channel plate for forming a first channel plate stack 1 or a second channel plate stack 2. According to this preferred design of the channel plate, a plurality of the channel-forming cut-outs 3 are formed concentrically in rings, wherein the stabilizing bridges 5 of adjacent ring-shaped channel-forming cut-outs 3 of this channel plate embodiment are radially offset. Unlike the embodiments of the channel plates 2.1 and 2.2 shown in FIGS. 3C and 3D, the stabilizing bridges 5 of adjacent ring-shaped channel-forming cut-outs 3 do not lie radially on one line. The positions of the stabilizing bridges 5 in the ring-shaped channel-forming cut-outs 3 of stacked channel plates of this embodiment are likewise different, so that the stabilizing bridges 5 of the stacked channel plates are offset in the resulting individual channels, which allows a fluid to flow through. Also, in contrast to the embodiments shown in FIGS. 3C and 3D, two half-moon-shaped first through-holes 4.1 and 4.2 separated from one another by a bridge 4.3 are situated in the centre of the channel plate 2.1. According to the concept of the invention, these channel plates can also be stacked to form first channel plate stacks 1 and second channel plate stacks 2 with separating plates 8 arranged therebetween, wherein the half-moon-shaped through-holes 4.1 and 4.2 each correspond with one another such that the first through-holes 4.1 form a distributor channel for distributing the first fluid into the individual plate planes of the first channel plate stacks 1 of the plate heat exchanger 7, wherein the first through-holes 4.2 form a collection channel for the first fluid flowing back out of the individual first channel plate stacks 1 of the plate heat exchanger 7. This embodiment likewise has fourteen bushings 13 for screws or bolts in order to allow screw-fastening.

Figure 4C:
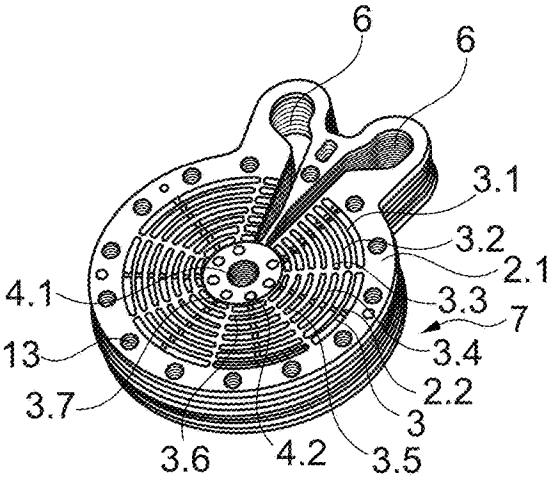
FIGS. 4A-4D: show schematic detail diagrams of channel plate stacks of the plate heat exchanger.
Figure 4B:
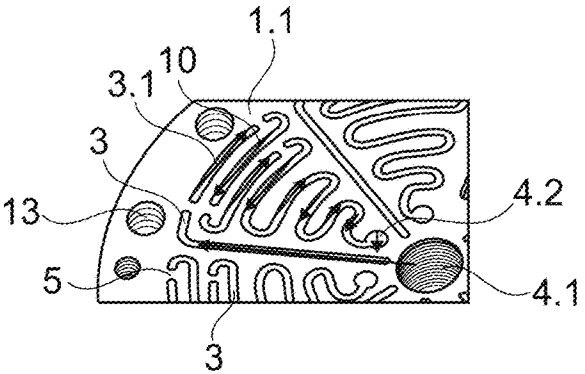
Figure 4A:
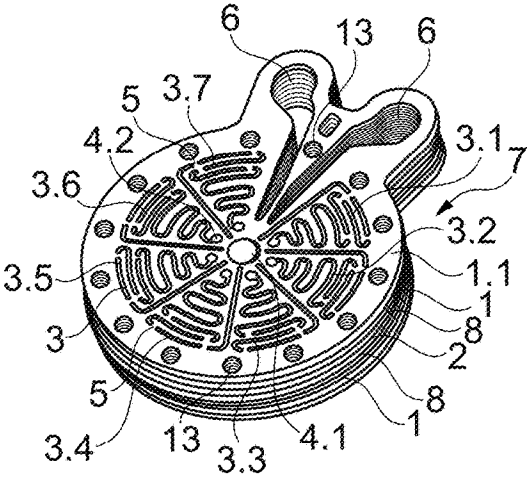

FIGS. 4A to 4D show schematic detail diagrams of channel plate stacks 1 and 2 of the plate heat exchanger 7. FIG. 4A shows multiple alternatingly stacked first and second channel plate stacks 1 and 2, which are separated fluidically from one another by separating plates 8. The diagram of FIG. 4A allows a view of a first channel plate stack 1, which is formed with a channel plate 1.1 (FIG. 3A) and a channel plate 1.2 (FIG. 3B). FIG. 4B shows a detail diagram of the first channel plate stack 1 that is formed from the channel plates 1.1 and 1.2 and in which the individual channels 3.1 to 3.7 for the first fluid are formed. The arrows 10 indicate the course of the flow of the first fluid through the individual channels 3.1 to 3.7 formed by the channel-forming through-holes 3 between the first through-holes 4.1 and 4.2. The formed stack of the plate heat exchanger has the plurality of bushings 13 for screws or bolts. The bushings 13 are also provided with the same reference signs in the following figures.

FIG. 4C shows multiple alternatingly stacked first and second channel plate stacks 1 and 2, which are separated fluidically from one another by separating plates 8. The diagram of FIG. 4C allows a view of a second channel plate stack 2, which is formed with a channel plate 2.1 (FIG. 3C) and a channel plate 2.2 (FIG. 3D). FIG. 4D shows a detail diagram of the second channel plate stack 2 formed from the channel plates 2.1 and 2.2. The arrows 11 indicate the course of the flow of the second fluid through the individual channels 3.1 to 3.7 formed by the channel-forming through-holes 3 between the second through-holes 6.

Figure 4E:
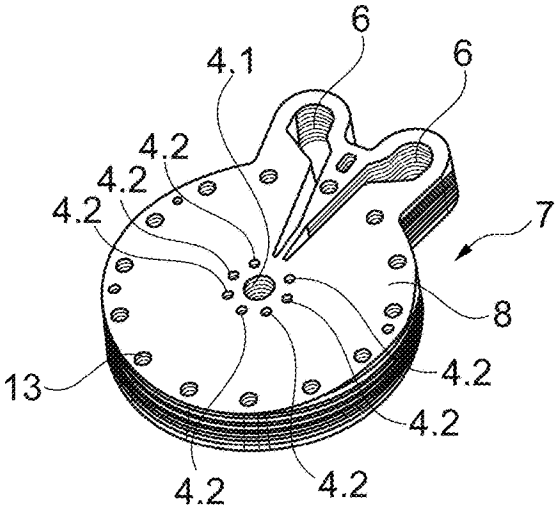
FIG. 4E: shows a schematic detail diagram of an exemplary embodiment of the plate heat exchanger with a view of a separating plate.
Figure 4D:
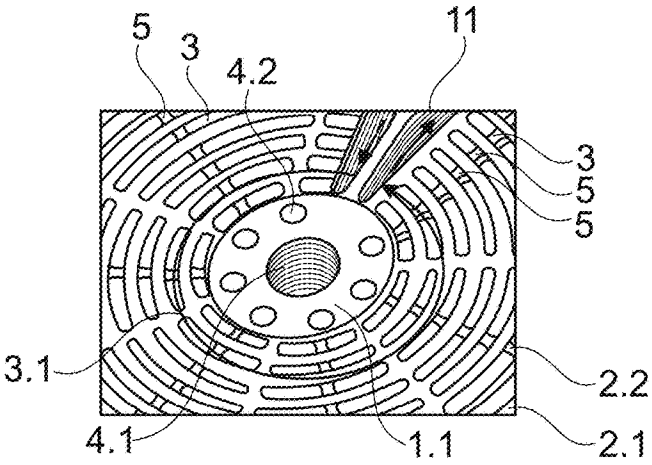

FIG. 4E shows a schematic detail diagram of an exemplary embodiment of the plate heat exchanger 7 with a view of a separating plate 8, a plurality of which are arranged in a stack with first and second channel plate stacks 1 and 2 in each case between first and second channel plate stacks 1 and 2. The separating plate 8 has first through-holes 4.1 and 4.2 and second through-holes 6. The first through-holes 4.1 and 4.2 and the second through-holes 6 correspond with the first through-holes 4.1 and 4.2 and second through-holes 6 formed in the channel plate stacks 1 and 2 and in the respective channel plates 1.1, 1.2 and 2.1 and 2.2.

FIGS. 5A and 5B show schematic diagrams of an embodiment of the plate heat exchanger 7 in an assembled form, wherein the individual plates are brazed to one another. FIG. 5A shows a view of the cover plate 9.1 of the plate heat exchanger 7. The channel plate stacks 1 and 2 are stacked on top of one another alternatingly with separating plates 8 arranged therebetween. The separating plates 8 each have first through-holes 4.1 and 4.2 and second through-holes 6 (covered), which each correspond with the first through-holes 4.1 and 4.2 and second through-holes 6 formed in the first and second channel stacks 1 and 2. The stacked arrangement of the first and second channel plate stacks 1 and 2 is delimited by the cover plates 9.1 and 9.2. The cover plate 9.1 has multiple first through-holes 4.2, which act as a fluid outlet for the first fluid. The second through-holes 6, which are formed in the protrusion 9 of the cover plate 9.1, have fluid connections 12.1 and 12.2 for the second fluid. The fluid connection 12.1 acts as a fluid inlet and the fluid connection 12.2 acts as a fluid outlet for the second fluid. This embodiment of the plate heat exchanger 7 is suitable for use as an integrated fluid-cooled gas cooler of a refrigerant compressor. In a corresponding use, the first fluid is a refrigerant, for example R744, wherein a coolant such as a water-glycol mixture is used as the second fluid.

FIG. 5B shows the underside of the plate heat exchanger 7 shown in FIG. 5A to allow a view of the cover plate 9.2. In the centre of the cover plate 9.2 there is a central first through-hole 4.1, which corresponds with the central first through-holes 4.1 formed in the channel plates 1.1, 1.2, 2.1 and 2.2 of the channel plate stacks 1 and 2. This central first through-hole 4.1 acts as a fluid inlet for the first fluid, which can be the refrigerant R744.

FIG. 6 shows an exploded diagram for more detailed explanation of the embodiment of a plate heat exchanger 7 as described in FIGS. 4 and 5. A plate heat exchanger 7 of this embodiment is suitable in particular for integration as an internal heat exchanger or integrated gas cooler in a refrigerant compressor. According to this embodiment, two channel plates 1.1 according to FIG. 3A and 1.2 according to FIG. 3B are arranged to form a first channel plate stack 1, wherein two further channel plates 2.1 according to FIG. 3C and 2.2 according to FIG. 3D are arranged to form a second channel plate stack 2. The first channel plate stack 1 and the second channel plate stack 2 are arranged between two cover plates 9.1 and 9.2 and separated by a separating plate 8 such that the opposing channels formed in the first and second channel plate stacks 1 and 2 are separated from one another and covered. A central first through-hole 4.1, which is provided as a fluid inlet for the first fluid, is formed in the cover plate 9.2, wherein the opposite cover plate 9.1 has seven first through-holes 4.2 provided as fluid outlets for the first fluid. The fluid connections 12.1 and 12.2, which are inserted into the protrusion 9 and brazed, are assigned to the second through-holes 6 for the second fluid.

LIST OF REFERENCE NUMERALS

1 First channel plate stack
1.1 Channel plate
1.2 Channel plate
2 Second channel plate stack
2.1 Channel plate
2.2 Channel plate
3 Channel-forming cut-out
3.1-3.7 Channel/individual channel
4, 4.1, 4.2 First through-hole
4.3 Bridge
5 Stabilizing bridge
6 Second through-holes
7 Plate heat exchanger
8 Separating plates
9 Protrusion
9.1 Cover plate
9.2 Cover plate
10 Arrows
11 Arrows
12.1 Fluid connection
12.2 Fluid connection
13 Bushings

What is claimed is:

1. A plate heat exchanger for a refrigerant circuit having channel plates with channel-forming cut-outs, of which at least two of the channel plates are in each case arranged into channel plate stacks, forming at least one channel, wherein a first one of the channel plate stacks for a first fluid and a second one of the channel plate stacks for a second fluid are stacked alternatingly between two cover plates with separating plates arranged therebetween to separate opposing ones of the at least one channel, at least one of the two cover plates has fluid connections for the first fluid and/or the second fluid, wherein each of the channel-forming cut-outs of at least one of the channel plates of the first one of the channel plate stacks and the second one of the channel plate stacks has at least one stabilizing bridge oriented transversely to the at least one channel, wherein the two cover plates, the first one of the channel plate stacks, the second one of the channel plate stacks, and the separating plates arranged therebetween have a circular body shape with a protrusion formed on an outer circumference, wherein a first through-hole is formed in the protrusion of the first one of the channel plate stacks, the second one of the channel plate stacks, and the separating plates, as well as the at least one of the two cover plates to form an inlet for the second fluid, wherein a second through-hole is formed in the protrusion of the first one of the channel plate stacks, the second one of the channel plate stacks, and the separating plates, as well as the at least one of the two cover plates to form an outlet for the second fluid, wherein a third through-hole is formed in the circular body shape of the first one of the channel plate stacks, the second one of the channel plate stacks, and the separating plates, as well as a first one of the two cover plates to form an inlet for the first fluid, and wherein a fourth through-hole is formed in the circular body shape of the first one of the channel plate stacks, the second one of the channel plate stacks, and the separating plates, as well as a second one of the two cover plates to form an outlet for the first fluid.

2. The plate heat exchanger according to claim 1, wherein the channel plates are formed from aluminum.

3. The plate heat exchanger according to claim 1, wherein the separating plates and/or the two cover plates have a greater material thickness than the channel plates of the first one of the channel plate stacks and the second one of the channel plate stacks.

4. The plate heat exchanger according to claim 1, wherein the first one of the channel plate stacks and the second one of the channel plate stacks are each formed with multiple stacked ones of the channel plates, wherein each second one of the channel plates has the at least one stabilizing bridge oriented transversely to the at least one channel.

5. The plate heat exchanger according to claim 1, wherein each of the channel plates of the first one of the channel plate stacks and the second one of the channel plate stacks has the at least one stabilizing bridge oriented transversely to the at least one channel, wherein the at least one of the stabilizing bridge of each of the channel plates stacked on top of one another are offset along a course of the at least one channel.

6. The plate heat exchanger according to claim 1, wherein the at least one stabilizing bridge of each of the channel-forming cut-outs of one of the channel plates has a width that is equal to a width of the at least one channel formed.

7. The plate heat exchanger according to claim 1, wherein the channel plates each have multiple ones of the channel-forming cut-outs, wherein each of the channel-forming cut-outs forms a channel structure with multiple individual ones of the at least one channel, wherein each of the multiple individual ones of the at least one channel has the at least one stabilizing bridge oriented transversely to the multiple individual ones of the at least one channel.

8. The plate heat exchanger according to claim 7, wherein the multiple individual ones of the at least one channel of the channel structure are spaced in parallel.

9. The plate heat exchanger according to claim 7, wherein the channel-forming cut-outs are arranged concentrically in rings, wherein the at least one stabilizing bridge of adjacent ones of the channel-forming cut-outs are radially offset.

10. The plate heat exchanger according to claim 9, wherein a width of the channel-forming cut-outs decreases from outside inwards.

11. The plate heat exchanger according to claim 1, wherein the channel plates, the separating plates, and the two cover plates each have multiple corresponding bushings for screws or bolts.

12. The plate heat exchanger according to claim 1, wherein the channel-forming cut-outs have a shape that forms the at least one channel with an at least partially serpentine course.

13. The plate heat exchanger according to claim 1, wherein the channel-forming cut-outs of the channel plates are formed by punching.

14. The plate heat exchanger according to claim 1, wherein the at least one channel of the first one of the channel plate stacks and the at least one channel of the second one of the channel plate stacks are fluidically separate, and one of the first through-hole, the second through-hole, the third through-hole, and the fourth through-hole of the first one of the channel plate stacks and one of the first through-hole, the second through-hole, the third through-hole, and the fourth through-hole of the second one of the channel plate stacks are fluidically connected in series or in parallel.

* * * * *